US007377308B2

(12) United States Patent
Ware

(10) Patent No.: US 7,377,308 B2
(45) Date of Patent: May 27, 2008

(54) DUAL TWO PASS STACKED PLATE HEAT EXCHANGER

(75) Inventor: Be A. Ware, Milwaukee, WI (US)

(73) Assignee: Modine Manufacturing Company, Racine, WI (US)

( * ) Notice: Subject to any disclaimer, the term of this patent is extended or adjusted under 35 U.S.C. 154(b) by 163 days.

(21) Appl. No.: 11/430,627

(22) Filed: May 9, 2006

(65) Prior Publication Data

US 2007/0261832 A1 Nov. 15, 2007

(51) Int. Cl.
*F28F 3/12* (2006.01)

(52) U.S. Cl. ..... 165/167; 165/170

(58) Field of Classification Search ..... 165/166, 165/167, 170

See application file for complete search history.

(56) References Cited

U.S. PATENT DOCUMENTS 4,815,534 A 3/1989 Fuerschbach
5,383,518 A 1/1995 Banks et al.
5,429,183 A 7/1995 Hisamori et al.
6,039,112 A 3/2000 Rappel et al.
6,244,334 B1 6/2001 Wu et al.
6,340,053 B1 1/2002 Wu et al.
6,340,054 B1 1/2002 Schwarz et al.
6,389,696 B1 5/2002 Heil et al.
6,394,178 B1 5/2002 Yoshida et al.
6,863,122 B2 3/2005 St. Pierre et al.

FOREIGN PATENT DOCUMENTS

WO WO 2005/031128 A1 4/2005

*Primary Examiner*—Teresa J. Walberg
(74) *Attorney, Agent, or Firm*—Michael Best & Friedrich LLP

(57) ABSTRACT

A stacked, embossed plate heat exchanger (10) is provided for transferring heat between a first fluid flowing in a plurality of U-shaped flow paths (12) through the heat exchanger (10) and a second fluid flowing in a plurality of U-shaped flow paths (14) through the heat exchanger (10). Embossed beads (44) and (46) are provided in each of the plates (18A,18B) and are embossed on opposite sides of the plate (18A,18B) to mate with corresponding ones of the beads (44) and (46) on adjacent plates (18A,18B) to define the respective U-shaped flow paths (12,14).

16 Claims, 5 Drawing Sheets

DUAL TWO PASS STACKED PLATE HEAT EXCHANGER

FIELD OF THE INVENTION

This invention relates to heat exchangers, and more particularly, to stacked plate heat exchangers.

BACKGROUND OF THE INVENTION

Stacked plate heat exchangers are known wherein a stack of plates are provided, with flow paths for the fluids of the heat exchanger defined between adjacent pairs of the plates in the stack. Typically, the plates will have inlet and outlet manifolds for each of the fluids of the heat exchanger, with the inlet and outlet manifolds being defined by aligned openings in the plates of the stack. Some of the stacked plate heat exchangers utilize embossed plates in the stack and a further subset of these heat exchangers are so-called housingless heat exchangers wherein the plates have peripheral flanges that cooperate to enclose the various flow paths for the fluids of the heat exchanger. Because such heat exchangers can be produced in a rather efficient and cost savings manner, there is a continuing desire to improve these heat exchangers.

SUMMARY OF THE INVENTION

In accordance with one feature of the invention, a stacked plate heat exchanger is provided for transferring heat between a first fluid flowing in a plurality of u-shaped flow paths through the heat exchanger to a second fluid flowing in a plurality of u-shaped flow paths through the heat exchanger. The heat exchanger includes a stack of embossed plates, with each of the plates having first and second oppositely facing sides, and the plates being stacked so that the first side of each plate faces the first side of an adjacent plate and the second side of each plate faces the second side of an adjacent plate. Each of the plates has a first pair of embossed ports located adjacent a first end and embossed from the first side of the plate, a second pair of embossed ports located adjacent a second end and embossed from the second side of the plate, a first elongated embossed bead embossed from the second side and having a length extending from between the first pair of embossed ports toward the second pair of embossed ports, and a second elongated embossed bead embossed from the first side and having a length extending from between the second pair of embossed ports toward the first pair of embossed ports. The second elongated embossed bead is offset transversely from the first elongated embossed bead. The first embossed bead of each plate engages the first embossed bead of an adjacent plate to define a first u-shaped flow path extending between the first pair of embossed ports, and the second embossed bead of each plate engages the second embossed bead of an adjacent plate to define a second u-shaped flow path extending between the second pair of embossed ports.

In one feature, the first and second embossed beads of each plate extend parallel to each other.

In accordance with one feature of the invention, a stacked plate heat exchanger includes a stack of embossed plates extending longitudinally between a first end and a second end; a first inlet manifold and a first outlet manifold located adjacent the first end and defined by aligned embossed ports of the plates in the stack; a second inlet manifold and a second outlet manifold located adjacent the second end and defined by aligned embossed ports of the plates in the stack;

a first plurality of u-shaped flow paths extending from the first inlet manifold to the first outlet manifold, with each of the first u-shaped flow paths defined by a first pair of mating embossed beads of an adjacent pair of the plates; and a second plurality of u-shaped flow paths interleaved in the stack with the first plurality of u-shaped flow paths and extending from the second inlet manifold to the second outlet manifold, with each of the second u-shaped flow paths defined by a second pair of mating embossed beads of an adjacent pair of the plates. The second pairs of mating embossed beads are transversely offset with respect to the first pairs of mating embossed beads and extend parallel with the first pairs of mating embossed beads. Each of the first pairs of mating embossed beads extending from the first end towards the second end, and each of the second pairs of mating embossed beads extending from the second end towards the first end. Each of the adjacent plates in the stack has one of the first embossed beads and one of the second embossed beads.

In one feature, the first and second embossed beads of each plate have ends that extend past each other.

As one feature, the first and second embossed beads of each plate are linear.

According to one feature, each of the plates has a peripheral flange that engages the peripheral flange of an adjacent plate to enclose the flow paths between the plates. As a further feature, each of the peripheral flanges are configured to nest with the peripheral flanges of adjacent plates in the stack. In yet a further feature, the heat exchanger further includes top and bottom cover plates, with the stack of plates being sandwiched there between.

In one feature, the heat exchanger further includes a first bypass plate, a second bypass plate, and a pair of cover plates sandwiching the stack of plates and the bypass plates there between. The first bypass plate mates with a face of the stack and including a first opening aligned with the inlet manifold of the stack, a second opening aligned with the outlet manifold of the stack, a first bypass channel extending from the first opening, and a second bypass channel extending from the second opening. The second bypass plate mates with a face of the first bypass plate opposite from the stack and includes a third bypass channel extending from a position overlying the first bypass channel to a position overlying the second bypass channel to define a bypass flow path extending from the first opening to the second opening.

Other objects, features, and advantages of the invention will become apparent from a review of the entire specification, including the appended claims and drawings.

DETAILED DESCRIPTION OF THE PREFERRED EMBODIMENTS

Figure 1:
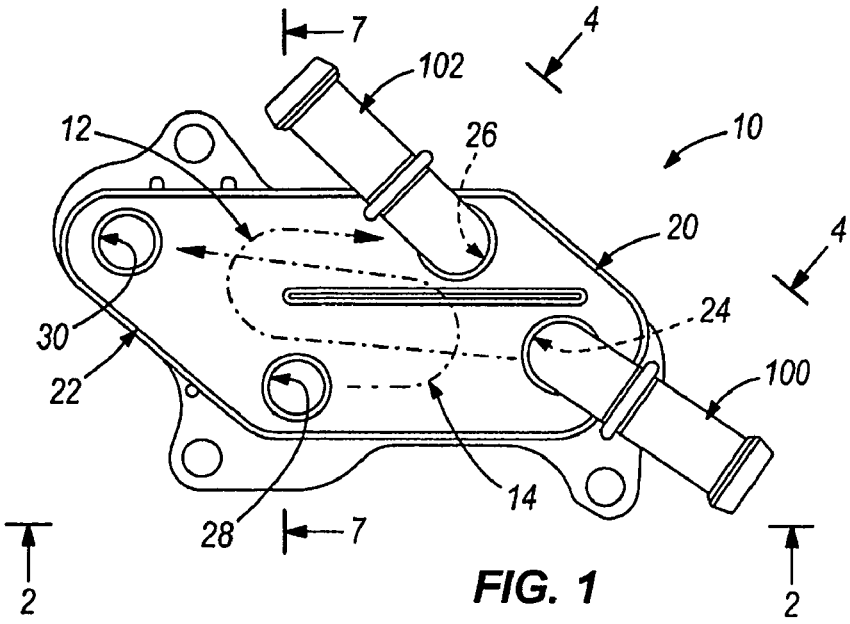
FIG. 1 is a plan view of a heat exchanger embodying the present invention.
Figure 2:
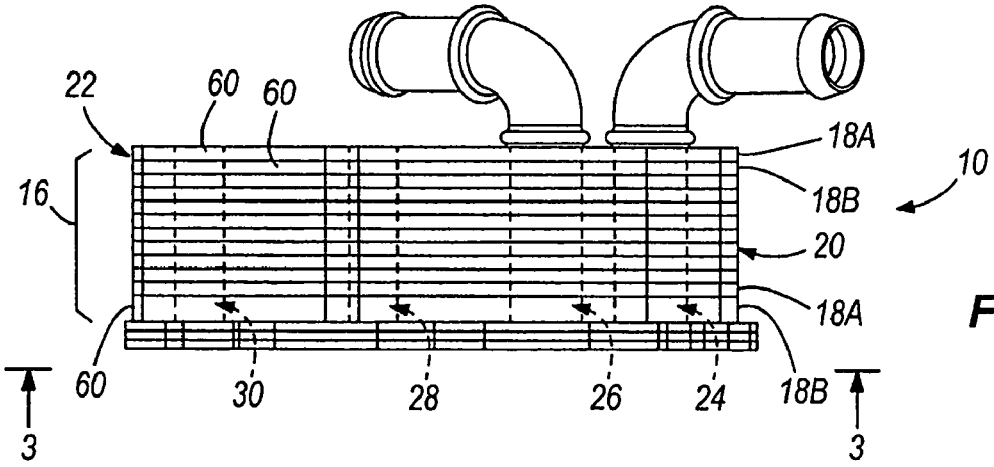
FIG. 2 is a side elevation taken from line 2-2 in FIG. 1.
Figure 3:
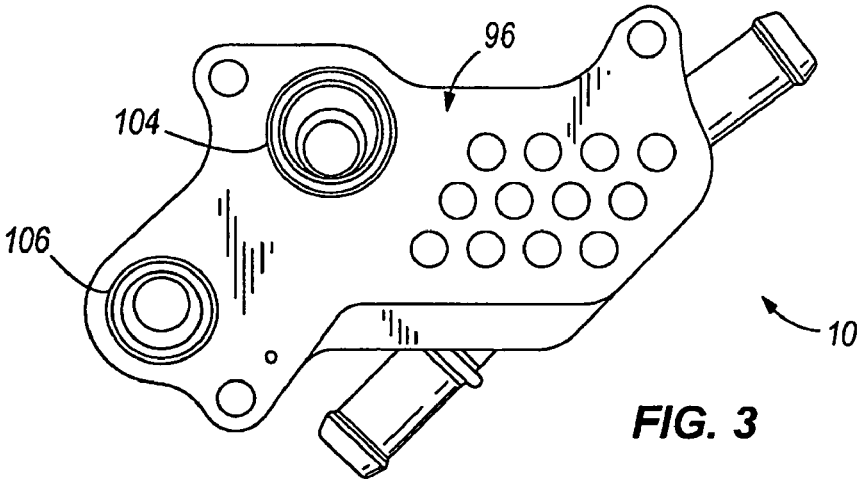
FIG. 3 is a bottom view taken from line 3-3 in FIG. 2.
Figure 4:
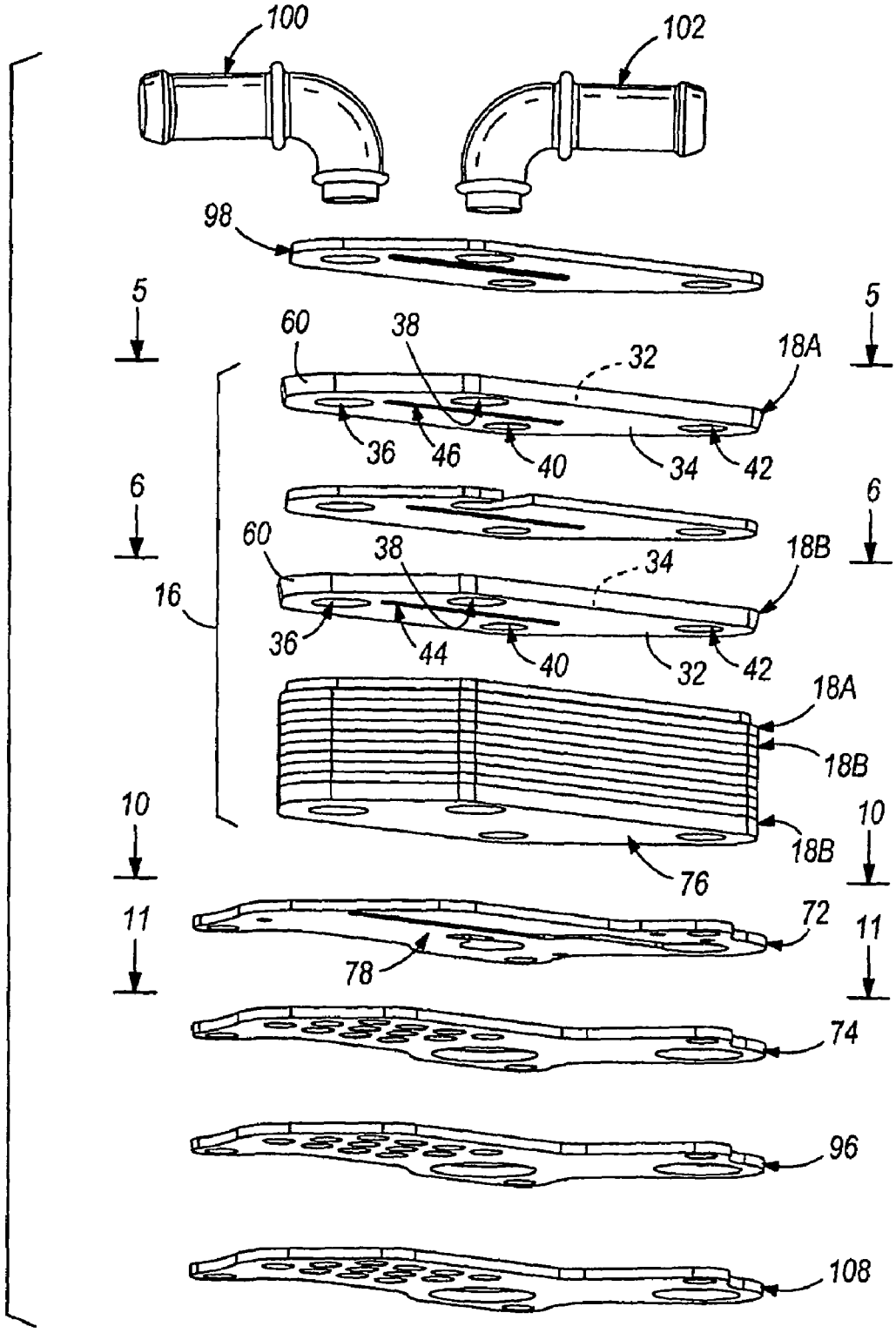
FIG. 4 is a partially exploded, reduced perspective view of the heat exchanger of FIGS. 1-3 taken from line 4-4 in FIG. 1.

With reference to FIGS. 1-4, a stacked plate heat exchanger 10 embodying the present invention is shown for transferring heat between a first fluid flowing through a plurality of U-shaped flow paths, shown schematically by arrows 12 in FIG. 1, through the heat exchanger 10 and a second fluid flowing through a plurality of U-shaped flow paths, shown schematically by arrows 14, through the heat exchanger 10. As best seen in FIGS. 2 and 4, the heat exchanger 10 includes a stack 16 of embossed plates 18A and 18B extending longitudinally between a first end 20 of the heat exchanger 10 and a second end 22 of the heat exchanger 10. An inlet manifold 24 and an outlet manifold 26 are located adjacent the first end 20 for directing the first fluid to and from the U-shaped flow paths 12. A second inlet manifold 28 and a second outlet manifold 30 are located adjacent the second end 22 for directing the second fluid flow to and from the U-shaped flow paths 14. Each of the manifolds 24, 26, 28 and 30 are defined by aligned embossed ports of the plates 18 in the stack 16, as will be described in more detail below and as is commonly done in stacked plate heat exchangers utilizing embossed plates.

As best seen in FIGS. 4-7, each of the plates 18A and 18B of the stack has oppositely facing, generally planar sides 32 and 34, with the plates 18A and 18B stacked so that the side 32 of each plate 18A faces the side 32 of an adjacent plate 18B and the side 34 of each plate 18A faces the side 34 of an adjacent plate 18B. Furthermore, each of the plates 18A and 18B has a first pair of embossed ports 36 and 38 located adjacent the first end 20 and embossed from the side 34 of the plate 18A, 18B; a second pair of embossed ports 40 and 42 located adjacent the second end 22 and embossed from the side 32 of the plate 18A, 18B; a first elongated, linear embossed bead 44 embossed from the side 32 and having a length extending from between the first pair of embossed ports 36,38 toward the second pair of embossed ports 40,42; and a second elongated, linear embossed bead 46 embossed from the side 34 and having a length extending from between the second pair of embossed ports 40,42 towards the first pair of embossed ports 36,38, with the second elongated embossed bead 46 being offset transversely from the first elongated embossed bead 44.

The embossed ports 36 are aligned to form the inlet manifold 24, the embossed ports 38 are aligned to define the outlet manifold 26, the embossed ports 40 are aligned to define the inlet manifold 28, and the embossed ports 42 are aligned to define the outlet manifold 30, with the embossed portions of the corresponding ports being bonded to each other to form a seal as is known for embossed, stacked plate heat exchanger constructions. As best seen in FIGS. 6 and 7, the embossed bead 44 of each plate 18A engages or mates with the embossed bead 44 of an adjacent plate 18B over the length of the beads 44 to define one of the U-shaped flow paths 12 between the sides 32 and extending from the port 36 to the port 38 As best seen in FIGS. 5 and 7, the second embossed bead 46 of each plate 18A engages or mates with the second embossed bead 46 of an adjacent plate 18B over the length of the beads 46 to define one of the second U-shaped flow paths 14 between the sides 34 and extending from the port 40 to the port 42.

Figure 5:
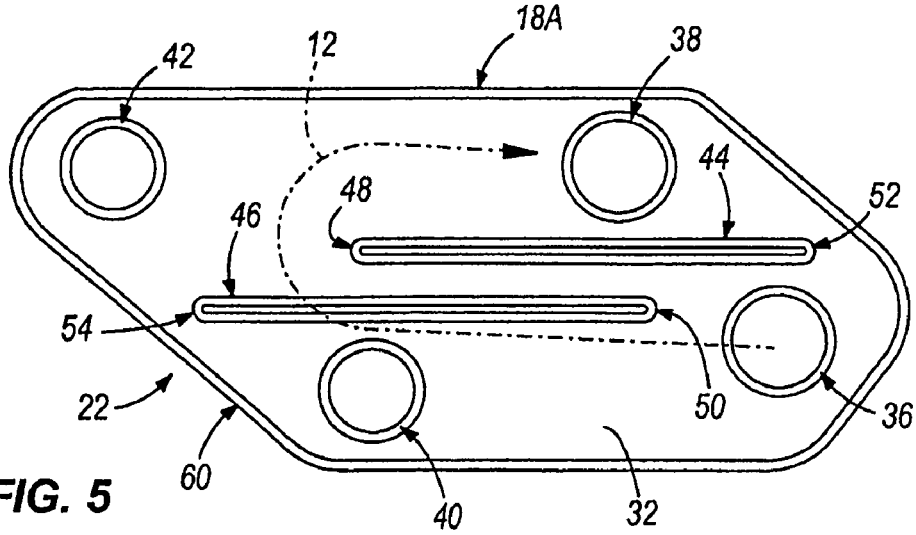
FIG. 5 is a plan view of an embossed plate taken from line 5-5 in FIG. 4.
Figure 6:
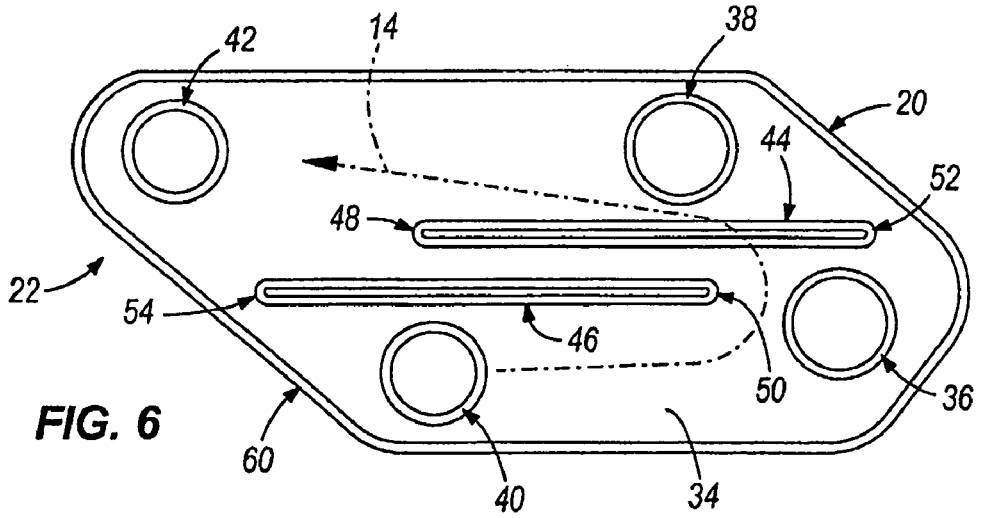
FIG. 6 is a plan view of another embossed plate taken from line 6-6 in FIG. 4.
Figure 7:
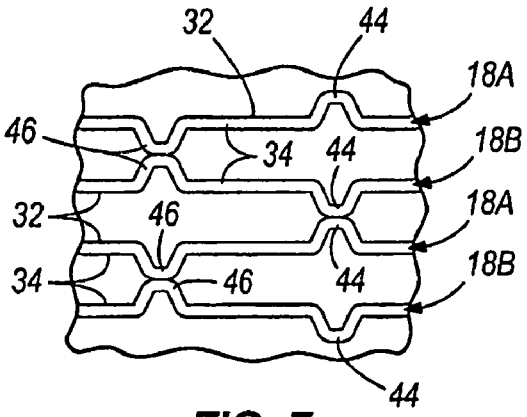
FIG. 7 is an enlarged, partial section view taken from line 7-7 in FIG. 1.

As best seen in FIGS. 5 and 6, the beads 44 and 46 have respective ends 48 and 50 that extend past each other in the longitudinal direction, so as to lengthen the respective flow paths 12 and 14. Similarly, each of the beads 44 and 46 have respective ends 52 and 54 that extend between the respective first and second pairs of ports 36,38 and 40,42 to minimize the amount of first and second fluid that bypasses the respective fluid flow paths 12 and 14.

With reference to FIG. 4, it can be seen that each of the plates 18A and 18B also preferably include a nesting peripheral flange 60 that nest with the peripheral flange 60 of the adjacent plates 18A and 18B in order to enclose the respective flow paths 12 and 14 and to provide for a so-called "housingless" heat exchanger. It should be understood that alternate types of peripheral flanges, such as beaded flanges, can provide the same function, and that it may be desirable to use such alternate peripheral flanges in some applications. Furthermore, it should be understood that in some applications it may be desirable to forego the peripheral flanges 60 and utilize some sort of suitable housing structure to enclose the flow paths 12 and 14.

Figure 8:
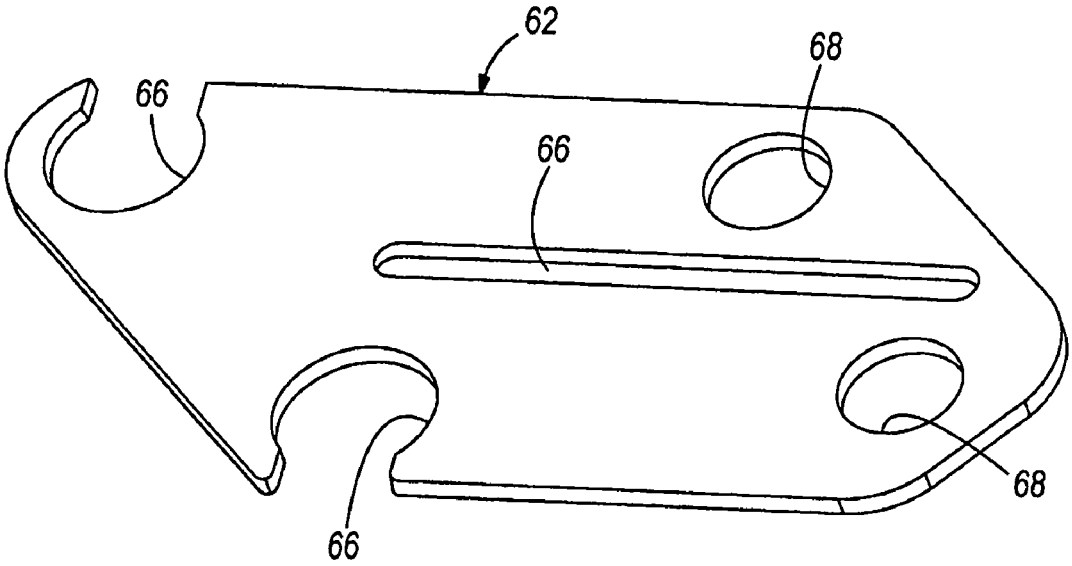
FIG. 8 is a perspective view of a turbulator/fin structure for use in the heat exchanger of FIGS. 1-4.
Figure 9:
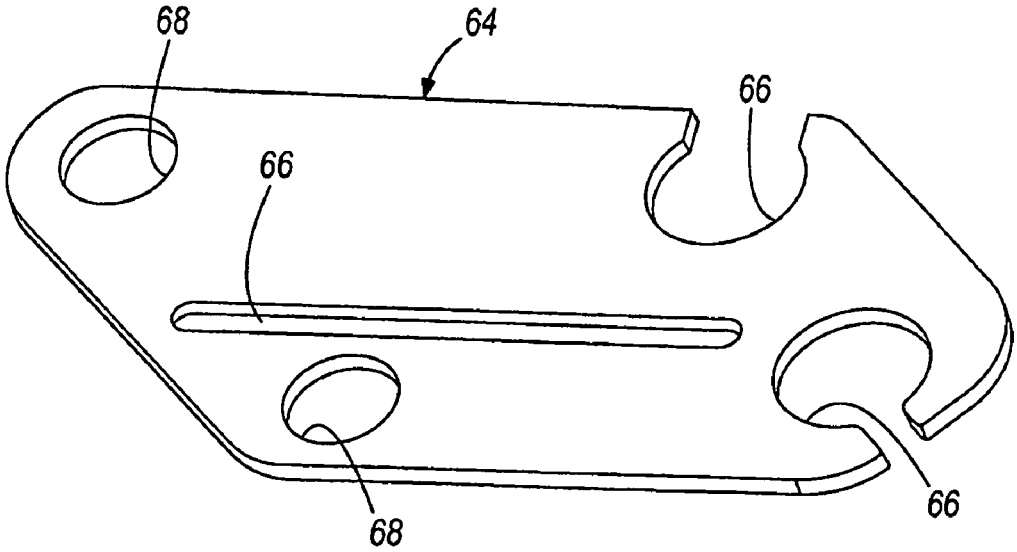
FIG. 9 is a perspective view of another turbulater/fin structure for use in the heat exchanger of FIGS. 1-4.

With reference to FIGS. 4, 8, and 9, surface enhancements in the form of suitable turbulater plates or fins 62 and 64 are preferably provided between each adjacent pair of plates 18A, 18B in the flow paths 12 and 14, respectively, to enhance the heat transfer between the two fluid flows (turbulator/fins 62,64 are not shown in FIG. 7). The turbulator/fins 62,64 can be any suitable surface enhancement such a lanced-and-offset turbulater or a serpentine or corrugated louvered fin. Cutout 66 must be provided to allow clearance for the embossed features 36, 38, 40, 42, 44, and 46. Additionally, openings 68 are preferably provided to all free flow of the fluids through the corresponding manifolds 24, 26, 28, and 30. While the turbulator/fins 62,64 are preferred, it may be desirable in some applications to forgo any type of surface enhancement, or to provide surface enhancements in the form of additional embossments formed in each of the plates 18A and 18B.

Figure 10:
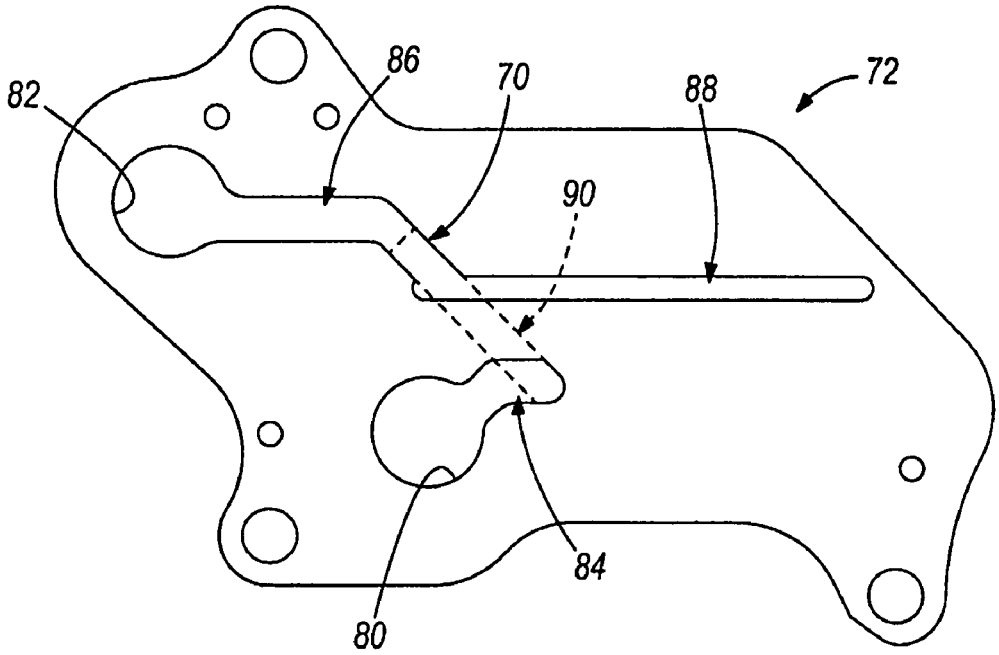
FIG. 10 is a plan view of a bypass plate taken from line 10-10 in FIG. 4.
Figure 11:
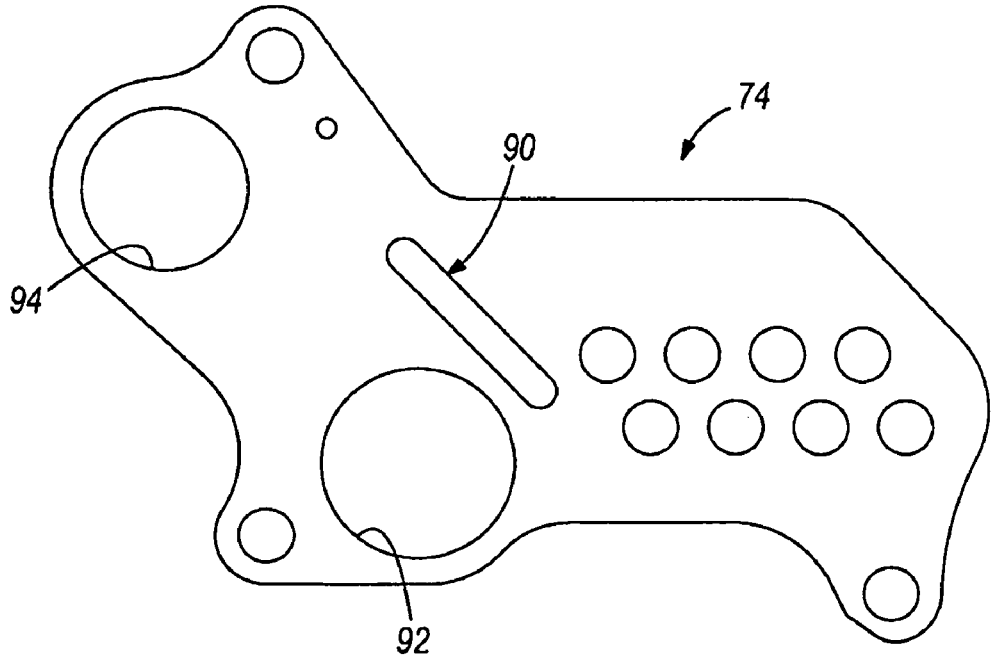
FIG. 11 is a plan view of another bypass plate taken from line 10-10 in FIG. 4.

With reference to FIGS. 4, 10, and 11, another feature of the invention is shown in the form of a bypass flow path 70 for the second fluid. In this regard, a pair of bypass plates 72 and 74 are provided, with the bypass plate 72 mating with a face 76 of the stack 16 defined by a lowermost one of the plates 18B, and the bypass plate 74 mating with a face 78 of the bypass plate 72 opposite from the stack 16. The plate 72 includes a first opening 80 aligned with the inlet manifold 28, a second opening 82 aligned with the outlet manifold 30, a first bypass channel 84 extending from the opening 80, and a second bypass channel 86 extending from the opening 82. The plate 72 also includes a clearance channel 88 to receive the embossed bead 44 of the lowermost plate 18B. The bypass plate 74 includes a third bypass channel 90 extending from a position overlying the first bypass channel 84 to a position overlying the second bypass channel 86 (as shown by the phantom lines in FIG. 10), to define the bypass flow path 70 extending from the first opening 80 and the manifold 28 to the second opening 82 and the manifold 30. The plate 74 also includes clearance openings 92 and 94 corresponding to the openings 80 and 82 respectively.

As best seen in FIG. 4, the heat exchanger 10 is completed by a base plate 96 and a top plate 98 that sandwich the stack 16 and the bypass plates 72,74 there between. Inlet and outlet fluid connections 100 and 102 are connected to the ports in the top plate 98 that are aligned with the manifolds 24 and 26 respectively. Inlet and outlet ports 104 and 106 are provided in the base plate 96 and are aligned with the manifolds 28 and 30 respectively. As seen in FIG. 4, A gasket plate 108 can be provided on the base plate 96 to provide suitable grooves for gaskets or seals for the ports 104,106 in the base plate 96.

The invention claimed is:

1. A stacked plate heat exchanger for transferring heat between a first fluid flowing in a plurality of U-shaped flow paths through the heat exchanger and a second fluid flowing in a plurality of U-shaped flow paths through the heat exchanger, the heat exchanger comprising:

a stack of embossed plates, each of the plates having first and second oppositely facing sides, the plates stacked so that the first side of each plate faces the first side of an adjacent plate and the second side of each plate faces the second side of an adjacent plate, each of the plates having a first pair of embossed ports located adjacent a first end and embossed from the first side of the plate, a second pair of embossed ports located adjacent a second end and embossed from the second side of the plate, a first elongated embossed bead embossed from the second side and having a length extending from between the first pair of embossed ports toward the second pair of embossed ports, and a second elongated embossed bead embossed from the first side and having a length extending from between the second pair of embossed ports toward the first pair of embossed ports, the second elongated embossed bead being offset transversely from the first elongated embossed bead, wherein the first embossed bead of each plate engages the first embossed bead of an adjacent plate to define a first U-shaped flow path extending between the first pair of embossed ports, and the second embossed bead of each plate engages the second embossed bead of an adjacent plate to define a second U-shaped flow path extending between the second pair of embossed ports.

2. The heat exchanger of claim 1 wherein the first and second embossed beads of each plate are linear.

3. The heat exchanger of claim 1 wherein the first and second embossed beads of each plate have ends that extend past each other.

4. The heat exchanger of claim 1 wherein the first and second embossed beads of each plate extend parallel to each other.

5. The heat exchanger of claim 1 wherein each of the plates has a peripheral flange that engages the peripheral flange of an adjacent plate to enclose the flow paths between the plates.

6. The heat exchanger of claim 5 wherein each of the peripheral flanges are configured to nest with the peripheral flanges of adjacent plates in the stack.

7. The heat exchanger of claim 5 further comprising top and bottom cover plates, with the stack of plates being sandwiched there between.

8. The heat exchanger of claim 1 further comprising:

a first bypass plate mating with a face of the stack and including a first opening aligned with one of the ports of a pair of port of a lowermost plate of the stack, a second opening aligned with the other port of the pair of ports of the lowermost plate of the stack, a first bypass channel extending from the first opening, and a second bypass channel extending from the second opening;

a second bypass plate mating with a face of the first bypass plate opposite from the stack and including a third bypass channel extending from a position overlying the first bypass channel to a position overlying the second bypass channel to define a bypass flow path extending from the first opening to the second opening; and a pair of cover plates sandwiching the stack of plates and the bypass plates there between.

9. A stacked plate heat exchanger comprising:

a stack of embossed plates extending longitudinally between a first end and a second end;

a first inlet manifold and a first outlet manifold located adjacent the first end and defined by aligned embossed ports of the plates in the stack;

a second inlet manifold and a second outlet manifold located adjacent the second end and defined by aligned embossed ports of the plates in the stack;

a first plurality of U-shaped flow paths extending from the first inlet manifold to the first outlet manifold, each of the first U-shaped flow paths defined by a first pair of mating embossed beads of an adjacent pair of the plates, each of the first pairs of mating embossed beads extending from the first end towards the second end; and a second plurality of U-shaped flow paths interleaved in the stack with the first plurality of U-shaped flow paths and extending from the second inlet manifold to the second outlet manifold, each of the second U-shaped flow paths defined by a second pair of mating embossed beads of an adjacent pair of the plates, the second pairs of mating embossed beads being transversely offset with respect to the first pairs of mating embossed beads and extending parallel with the first pairs of mating embossed beads, each of the second pairs of mating embossed beads extending from the second end towards the first end, each of the adjacent plates in the stack having one of the first embossed beads and one of the second embossed beads.

10. The heat exchanger of claim 9 wherein the first and second embossed beads of each plate are linear.

11. The heat exchanger of claim 9 wherein the first and second embossed beads of each plate have ends that extend past each other.

12. The heat exchanger of claim 9 wherein each of the plates has a peripheral flange that engages the peripheral flange of an adjacent plate to enclose the flow paths between the plates.

13. The heat exchanger of claim 12 wherein each of the peripheral flanges are configured to nest with the peripheral flanges of adjacent plates in the stack.

14. The heat exchanger of claim 12 further comprising top and bottom cover plates, with the stack of plates being sandwiched there between.

15. The heat exchanger of claim 9 further comprising:

a first bypass plate mating with a face of the stack and including a first opening aligned with the first inlet manifold of the stack, a second opening aligned with the first outlet manifold of the stack, first bypass channel extending from the first opening, and a second bypass channel extending from the second opening;

a second bypass plate mating with a face of the first bypass plate opposite from the stack and including a third bypass channel extending from a position overlying the first bypass channel to a position overlying the second bypass channel to define a bypass flow path extending from the first opening to the second opening; and a pair of cover plates sandwiching the stack of plates and the bypass plates there between.

16. A stacked plate heat exchanger for transferring heat between first and second fluids, the heat exchanger comprising:

a stack of plates defining interleaved flow paths for the first and second fluids between adjacent pairs of the plates, the plates including a first set of aligned openings defining an inlet manifold for the first fluid and a second set of aligned openings defining an outlet manifold for the first fluid;

a first bypass plate mating with a face of the stack and including a first opening aligned with the inlet manifold of the stack, a second opening aligned with the outlet manifold of the stack, first bypass channel extending from the first opening, and a second bypass channel extending from the second opening;

a second bypass plate mating with a face of the first bypass plate opposite from the stack and including a third bypass channel extending from a position overlying the first bypass channel to a position overlying the second bypass channel to define a bypass flow path extending from the first opening to the second opening; and a pair of cover plates sandwiching the stack of plates and the bypass plates there between.

* * * * *